US012016391B2

(12) United States Patent
Reevell

(10) Patent No.: US 12,016,391 B2
(45) Date of Patent: Jun. 25, 2024

(54) INDUCTIVELY HEATED AEROSOL-GENERATING DEVICE COMPRISING A REUSABLE SUSCEPTOR

(71) Applicant: PHILIP MORRIS PRODUCTS S.A., Neuchatel (CH)

(72) Inventor: Tony Reevell, London (GB)

(73) Assignee: PHILIP MORRIS PRODUCTS S.A., Neuchatel (CH)

( * ) Notice: Subject to any disclaimer, the term of this patent is extended or adjusted under 35 U.S.C. 154(b) by 1358 days.

(21) Appl. No.: 16/480,351

(22) PCT Filed: Feb. 6, 2018

(86) PCT No.: PCT/EP2018/052898
§ 371 (c)(1),
(2) Date: Jul. 24, 2019

(87) PCT Pub. No.: WO2018/146071
PCT Pub. Date: Aug. 16, 2018

(65) Prior Publication Data

US 2019/0380391 A1 Dec. 19, 2019

(30) Foreign Application Priority Data

Feb. 7, 2017 (EP) ..... 17155037

(51) Int. Cl.
*A24F 47/00* (2020.01)
*A24F 40/465* (2020.01)
(Continued)

(52) U.S. Cl.
CPC ..... *A24F 40/465* (2020.01); *A24F 40/20* (2020.01); *A24F 40/485* (2020.01)

(58) Field of Classification Search
CPC ..... A24F 40/465
See application file for complete search history.

(56) References Cited

U.S. PATENT DOCUMENTS 5,816,263 A 10/1998 Counts
8,342,184 B2 1/2013 Inagaki
(Continued)

FOREIGN PATENT DOCUMENTS

CN 203748668 U 8/2014
CN 104095291 10/2014
(Continued)

OTHER PUBLICATIONS

PCT Search Report and Written Opinion for PCT/EP2018/052898 dated Apr. 6, 2018 (13 pages).
(Continued)

*Primary Examiner* — Eric Yaary
(74) *Attorney, Agent, or Firm* — Oblon, McClelland, Maier & Neustadt, L.L.P.

(57) ABSTRACT

The present invention relates to an aerosol-generating device (1) for generating an aerosol by inductively heating an aerosol-forming substrate (30). The device comprises a device housing (10) including a heating chamber (16) for receiving an aerosol-forming substrate to be heated and an induction source for generating an alternating electromagnetic field within the heating chamber. The device further comprises a reusable susceptor (20) configured to get into removable contact with the aerosol-forming substrate for heating the substrate. The susceptor is displaceable between an operation position defined by the susceptor being arranged within the heating chamber (16), and a preparation position defined by the susceptor being arranged at least partially outside of the heating chamber. The invention further relates to aerosol-generating system comprising an aerosol-generating device according to invention and an aerosol-generating article including aerosol-forming substrate to be heated.

23 Claims, 4 Drawing Sheets

(51) Int. Cl.
*A24F 40/20* (2020.01)
*A24F 40/485* (2020.01)

(56) References Cited

U.S. PATENT DOCUMENTS

| | | | | |
|---|---|---|---|---|
| 9,854,838 | B1 * | 1/2018 | Laible | A24F 40/40 |
| 2004/0144396 | A1 | 7/2004 | Reeve | |
| 2014/0373856 | A1 * | 12/2014 | Zuber | A24F 47/00 131/328 |
| 2015/0189915 | A1 | 7/2015 | Liu | |
| 2017/0055583 | A1 * | 3/2017 | Blandino | H05B 6/36 |

FOREIGN PATENT DOCUMENTS

| | | | |
|---|---|---|---|
| CN | 104489933 | A | 4/2015 |
| CN | 204444230 | U | 7/2015 |
| CN | 204949521 | U | 1/2016 |
| CN | 204969474 | U | 1/2016 |
| CN | 205648910 | U | 10/2016 |
| CN | 106163309 | A | 11/2016 |
| CN | 108135263 | A | 6/2018 |
| JP | 2014-534813 | A | 12/2014 |
| JP | 2016-524458 | A | 8/2016 |
| KR | 10-2015-0143877 | A | 12/2015 |
| KR | 10-2016-0093597 | A | 8/2016 |
| KR | 10-2016-0096076 | A | 8/2016 |
| KR | 10-2017-0008722 | A | 1/2017 |
| KR | 10-2017-0008730 | A | 1/2017 |
| RU | 2 517 125 | C2 | 5/2014 |
| WO | WO 2013/022936 | | 2/2013 |
| WO | WO 2013/034453 | | 3/2013 |
| WO | WO 2014/047955 | | 4/2014 |
| WO | WO 2015/177046 | | 11/2015 |
| WO | WO 2015/177253 | A1 | 11/2015 |
| WO | WO 2015/177254 | | 11/2015 |
| WO | WO-2015177046 | A1 * | 11/2015 ..... A24F 40/42 |
| WO | WO 2016/120177 | A1 | 8/2016 |
| WO | WO 2016/200815 | A2 | 12/2016 |
| WO | WO 2017/068101 | | 4/2017 |

OTHER PUBLICATIONS

Combined Chinese Office Action and Search Report dated Nov. 18. 2021 in Chinese Patent Application No. 201880009860.8 (with English translation), 14 pages.

Chinese Office Action dated Jun. 8, 2022 in Chinese Patent Application No. 201880009860.8 (with English translation), 12 pages.

Korean Notice of Allowance issued Jul. 14, 2023 in Korean Patent Application No. 10-2019-7026085 (with English Translation), citing references 15-19 therein, 3 pages.

Combined Chinese Office Action and Search Report dated Sep. 26, 2022 in Patent Application No. 201880009860.8 (with English language translation), 16 pages.

Russian Search Report dated Jun. 4, 2021 in Russian Patent Application No. 2019127906/03(054789) (with English language translation), 4 pages.

Decision of Grant dated Mar. 7, 2022 in the Japanese Application No. 2019-63681, 1 page.

Fourth Office Action dated Feb. 1, 2023 in the corresponding Chinese Patent Application No. 201880009860.8 (with English Translation) therein, 18 pages.

* cited by examiner

INDUCTIVELY HEATED AEROSOL-GENERATING DEVICE COMPRISING A REUSABLE SUSCEPTOR

This application is a U.S. National Stage Application of International Application No. PCT/EP2018/052898 filed Feb. 6, 2018, which was published in English on Aug. 16, 2018, as International Publication No. WO 2018/146071 A1. International Application No. PCT/EP2018/052898 claims priority to European Application No. 17155037.9 filed Feb. 7, 2017.

The present invention relates to an inductively heated aerosol-generating device comprising a reusable susceptor. The invention further relates to aerosol-generating system comprising such a device and an aerosol-generating article including an aerosol-forming substrate to be heated.

Aerosol-generating devices and systems based on inductively heating an aerosol-forming substrate are generally known from prior art. These devices and systems typically comprise an induction source for generating a high frequency electromagnetic field. The field causes at least one of, heat generating eddy currents or heat generating hysteresis losses, in the material of a susceptor. The thus heated susceptor is in thermal proximity of an aerosol-forming substrate which is capable of releasing volatile compounds that form an aerosol upon heating. The susceptor may be integral part of an aerosol-generating device. In particular, the susceptor may be arranged within a heating chamber of the device which is configured for receiving the substrate to be heated. Alternatively, the susceptor may be integral part of an aerosol-generating article which includes the substrate to be heated and which is configured to be received in a heating chamber of an aerosol-generating device.

In the latter case, the susceptor may be usually only used once due to the fact that the susceptor typically is inextricably integrated in the article itself. Therefore, aerosol-generating articles having an integral susceptor are disposable consumables to be discarded after a single use. In contrast, susceptors being integral part of an aerosol-generating device may be used several times. However, as the aerosol-forming substrate is typically in direct contact with the susceptor, the substrate may leave residues on the surface of the susceptor. Therefore, the susceptor needs to be frequently cleaned. Yet, cleaning of a susceptor which is integrated in a heating chamber of an aerosol-generating device may be difficult and cumbersome due to the spatially limited accessibility of the susceptor.

Therefore, it would be desirable to have an aerosol-generating device and system with the advantages of prior art solutions but without their limitations. In particular, it would be desirable to have an aerosol-generating device and system having a reusable susceptor that may be easily accessible, in particular for preparation purposes such as cleaning.

According to the invention there is provided an aerosol-generating device for generating an aerosol by inductively heating an aerosol-forming substrate. The device comprises a device housing including a heating chamber for receiving an aerosol-forming substrate to be heated. Within the device housing, the device also comprises an induction source for generating an alternating electromagnetic field within the heating chamber. The device further comprises a reusable susceptor which is configured to get into removable contact with the aerosol-forming substrate for heating the substrate. The susceptor is configured to be displaceable between at least two positions: an operation position that is defined by the susceptor being arranged within the heating chamber, and a preparation position that is defined by the susceptor being arranged at least partially outside of the heating chamber.

According to the invention, it has been recognized that a reusable susceptor being integral part of an aerosol-generating device may be readily accessible by making the susceptor to be at least partially displaceable out of the device. In particular, it has been recognized that displacement of a susceptor is technically very easy to be achieved due to the fact that inductive heating is a form of "contactless heating". Thus, inductive heating of the susceptor does not require any wiring of the susceptor. For this reason, the susceptor may be physically unattached from any other parts of the aerosol-generating device which advantageously allows the susceptor to be readily displaceable. In particular, the susceptor may be completely displaceable out of the heating chamber or even out of the device housing.

As used herein, the "operation position" corresponds to a position of the susceptor within the heating chamber. In this position, the susceptor is arranged relative to the induction source such as to experience the alternating electromagnetic field generated by the induction source. Therefore, the susceptor is heatable in the operation position. Preferably, the susceptor may be heatable only in the operation position. Even more preferably, the aerosol-generating device may be configured such that heating and thus aerosol generation is only possible or only occurs when the susceptor is in the operation position. Vice versa, the aerosol-generating device may be configured such that heating and thus aerosol generation preferably stops or is inhibited when the susceptor is not in the operation position. The operation position may be defined by the susceptor being entirely or completely arranged within the heating chamber.

As used herein, the "preparation position" corresponds to a position of the susceptor in which the susceptor is arranged at least partially outside of the heating chamber, preferably outside of the device housing. Preferably, the preparation position is defined by the susceptor being arranged at least partially outside of the heating chamber, preferably outside of the device housing, such that at least that part of the susceptor which is arranged outside of the heating chamber, preferably outside of the device housing, in the preparation position is freely accessible from at least two orthogonal directions. As used herein, the term "freely accessible from at least two orthogonal directions" preferably is meant such that no other parts of the aerosol-generating device obstruct a straight passage along the at least two orthogonal directions to at least said part of the susceptor which is arranged outside of the heating chamber, preferably outside of the device housing, in the preparation position. In the preparation position, the susceptor may even be arranged completely outside of the heating chamber, or even more, outside of the device housing. Thus, in any case, the susceptor is readily accessible in the preparation position for any preparation purposes. For example, preparation may include at least one of cleaning the susceptor, removing used-up aerosol-forming substrate from the susceptor or fitting the susceptor with unused aerosol-forming substrate.

As used herein, the term "susceptor" refers to an element comprising a material that is capable to convert electromagnetic energy into heat. Thus, when located in an alternating electromagnetic field, the susceptor is heated. This may be the result of hysteresis losses and/or eddy currents induced in the susceptor, depending on the electrical and magnetic properties of the susceptor material. Hysteresis losses occur in ferromagnetic or ferrimagnetic susceptor materials due to magnetic domains within the material being switched under the influence of an alternating electromagnetic field. Eddy currents occur in electrically conductive susceptor materials. In case the susceptor material is both, electrically conductive and ferromagnetic or ferrimagnetic, heat can be generated due to both, eddy currents and hysteresis losses.

Preferably, the susceptors is a metal susceptor. For example, the susceptor may comprise ferritic iron, or a paramagnetic or ferromagnetic metal or metal alloy, such as aluminium or ferromagnetic steel, in particular ferromagnetic stainless steel. The susceptor may also comprise or may be made of austenitic steel, austenitic stainless steel, graphite, molybdenum, silicon carbide, niobium, Inconel alloys (austenite nickel-chromium-based super-alloys), metallized films, ceramics such as for example a ferrimagnetic ceramic material or zirconia, transition metals such as for example Fe, Co, Ni, or metalloids components such as for example B, C, Si, P, Al.

The susceptor may comprise a non-metallic core with a metal layer disposed on the non-metallic core, for example metallic tracks formed on a surface of a ceramic core. The susceptor may have a protective external layer, for example a protective ceramic layer or protective glass layer encapsulating the susceptor. The susceptor may comprise a protective coating formed by a glass, a ceramic, or an inert metal, formed over a core of susceptor material.

The susceptor may be solid, hollow or porous. Preferably, the susceptor is a solid which advantageously provides sufficient stiffness of the susceptor for penetrating the aerosol-forming substrate.

As used herein, "reusable susceptor" refers to a susceptor which is configured for multiple use with a plurality of substrates. Thus, the susceptor is configured to get into contact with and to heat a plurality of substrates one after the other. In particular, this implies that the susceptor is configured to get into removable contact with the substrate to be heated. As used herein, "getting into removable contact" means that the susceptor is configured to non-destructively get into and out of contact with the substrate such that the susceptor may be used again with another substrate. The contact between the susceptor and the substrate is such that heat can be transferred from the susceptor to the substrate. In particular, the susceptor may get into direct contact with the aerosol-forming substrate. The susceptor may be configured to get into contact with an exterior of the aerosol-forming substrate such as to heat the substrate from the outside. For example, the susceptor may comprise a cavity, a receptacle, a tube or a sleeve for receiving aerosol-forming substrate to be heated. Alternatively, the susceptor may include a plate to be contacted with the exterior of the substrate. The susceptor may also be configured to get into contact with an interior of the aerosol-forming substrate such as to heat the substrate from the inside. Preferably, the susceptor is configured for penetrating at least a portion of the aerosol-forming substrate. Advantageously, this allows to efficiently use a majority of the generated heat for heating the substrate without significant heat loss to the environment.

In general, the susceptor may be of any shape or dimension. Preferably, the susceptor may have an elongated shape. This may prove advantageous to facilitate penetration of the aerosol-forming substrate. In particular, at least a section of the susceptor is one of a rod, a full cylinder, a blade, a needle, or a lance. Alternatively, at least a section of the susceptor is one of a receptacle or a cavity, in particular a tube, a sleeve, or a hollow cylinder. Preferably, at least a section of the susceptor comprises a continuous cross-sectional profile.

Upon getting into the contact with the aerosol-forming substrate, the susceptor may be removably attached to substrate. In particular, the susceptor may be in friction-fit with the aerosol-forming substrate. Advantageously, this allows for captively and securely coupling either the susceptor to the substrate or the substrate to the susceptor such as to prevent either one of both to get detached from the other. Advantageously, this also improves the heat transfer from the susceptor to the aerosol-forming substrate.

The displaceability of the susceptor between the operation position and the preparation position may be realized in different ways. In particular, the susceptor may be manually displaceable between the operation and preparation.

According to one possibility, the susceptor may be moveably coupled to the device housing. Preferably, the susceptor may be slidably mounted in the device housing, in particular in the heating chamber, such as to be displaceable between the operation position and the preparation position by a sliding movement. For example, the susceptor may comprise a support section that is slidably guided within the heating chamber, for example in a form fitting manner. The aerosol-generating device may also comprise one or more guide members, such as guide pins, for slidably guiding the susceptor. The aerosol-generating device may further comprise a stopper for preventing the moveably coupled or slidably mounted susceptor from being removed from the device housing.

According to another possibility, the aerosol-generating device may be at least two-part. The aerosol-generating device may comprise at least a first part and a second part which are removably attached to each other. The first part may comprise the heating chamber in which the susceptor may be arranged in the operation position. In contrast, the second part may comprise the susceptor attached thereto. Accordingly, by assembling and disassembling the first and second part, the susceptor may be displaced between an arrangement within the heating chamber (operation position) and an arrangement at least partially outside of the heating chamber (preparation position). Preferably, the aerosol-generating device may comprise a main body (as first part) and a mouthpiece (as second part), wherein the mouthpiece is removably attached to the main body. The main body may comprise the heating chamber, whereas the susceptor may be attached to the removable mouthpiece. Thus, when attaching the mouthpiece to the main body, the susceptor may be arranged in the operation position within the heating chamber. Vice versa, by removing the mouthpiece from the main body, the susceptor may be removed out of the operation position and transferred into the preparation position at least partially outside of the heating chamber. To further increase the accessibility of the susceptor or to allow for replacing the susceptor, the susceptor may be removably attached to the mouthpiece.

According to yet another possibility, the displaceability of the susceptor may be realized by a susceptor that is completely separate from any other parts of the aerosol-generating device. Thus, the susceptor may be freely movable relative to the heating chamber and the device housing. Preferably, the susceptor may be completely displaceable out of the heating chamber, or even more, out of the device housing. In the operation position, the susceptor may be indirectly coupled to the heating chamber via the aerosol-forming substrate to be received in the heating chamber. Accordingly, for arranging the susceptor in the operation position, the susceptor may be configured to be mountable within the heating chamber by removably attaching the susceptor to the aerosol-forming substrate and subsequently removably arranging the aerosol-forming substrate in the heating chamber. Vice versa, by removing the aerosol-forming substrate having the susceptor attached thereto the susceptor may be displaced out of the heating chamber into the preparation position. Preferably, the susceptor and the substrate are attached to each other due to friction-fit. For example, the susceptor may be attached to the substrate by penetrating at least a portion of the aerosol-forming substrate to be heated. Likewise, the aerosol-forming substrate having the susceptor attached thereto may be also securely arranged in the heating chamber due to friction-fit. Further possibilities for securely receiving the aerosol-forming substrate in the heating chamber will be explained below.

According to the invention, the heating chamber is configured for receiving the aerosol-forming substrate. For this, the heating chamber may comprise a cavity or a receptacle. The heating chamber may further comprise at least one of an air inlet, an air outlet or an air passageway passing therethrough. The heating chamber may be open permanently, for example at one end. Alternatively, the heating chamber may be removably closed in heating operation of the device and openable for inserting and removing the aerosol-forming substrate. For example, a main body of the device may comprise the heating chamber which is closed by a mouthpiece of the device. The mouthpiece, in turn, may be removably attached to the main body of the device. However, the closed state of the heating chamber does not exclude that the heating chamber may comprise an air inlet, an air outlet and an air passageway passing therethrough.

Preferably, the aerosol-forming substrate is securely received in the heating chamber. As used herein, "securely received" means that the aerosol-forming substrate is releasable held in the heating chamber in a fixed position. The aerosol-generating device may be configured such as to hold the aerosol-forming substrate in the heating chamber due to at least one of friction-fit or form-fit. The aerosol-generating device may be configured such the aerosol-forming substrate is securely retained in the heating chamber at least against a force that corresponds to the total weight of the substrate or the total weight of the substrate and the susceptor. For example, the aerosol-generating device may comprise a clamp mounting or a piercing mounting for engagement with the aerosol-forming substrate.

The susceptor may be captively coupled to the device housing, either for preventing the susceptor from being completely removed from the heating chamber or the device housing, or for preventing the susceptor to get lost in case the susceptor is completely removed from the heating chamber of the device housing. For example, the aerosol-generating device may comprise a stopper for preventing the susceptor, from being completely removed from the heating chamber. Alternatively, the susceptor may be displaceably coupled to the device housing by a cord, a chain, a robe, a tether or a cable.

The susceptor may comprise a heating section which is magnetically susceptive and thus inductively heatable. The heating section is configured to get at least partially into contact with the aerosol-forming substrate. For example, the heating section is configured for removably penetrating an internal portion of the aerosol-forming substrate.

The susceptor may further comprise a support section. Preferably, the support section is magnetically non-susceptive, that is inductively non-heatable. The support section may be also configured to get at least partially into contact with the aerosol-forming substrate. The support section may be arranged at one end of the susceptor, preferably at a posterior end of the susceptor. The posterior end is opposite to an anterior end of the susceptor which may be configured for getting into contact with the aerosol-forming substrate first. The anterior end may be a free end or a detached end. Preferably, the heating section is arranged at or even forms the anterior end of the susceptor.

The support section may be removably attached to another section of the susceptor, in particular to the heating section of the susceptor. The support section advantageously facilitates to insert and remove the susceptor into and from the aerosol-forming substrate. For example, the support section may be a grasp or a knob for grasping the susceptor. The support section may be configured for removably holding the susceptor in the operation positon within the heating chamber. That is, the susceptor may be removably attached by the support section to the device housing, the heating chamber or a main body of the device. For this, the support section may be removably attached to at least one of the device housing, the heating chamber the main body, or another section of the susceptor, in particular to a heating section.

Alternatively, the susceptor may be slidably mounted in the device housing, in particular the heating chamber or the main body, by the support section.

The susceptor may be also attached to a mouthpiece of the device by the support section. The support section may be even removably attached, either to the mouthpiece or to another section of the susceptor, in particular to a heating section, or to both, the mouthpiece or to another section of the susceptor.

For removably attaching the support section to either one of the heating chamber, the device housing, the main body, the mouthpiece, the heating section or another section of the susceptor, the susceptor may comprise at least one of a clamp mount, a screw mount, a snap mount, or a magnetic mount.

The support section may have the same shape as any other section of the susceptor, in particular the heating section. Advantageously, this facilitates the susceptor to penetrate the aerosol-forming substrate. The support section may have at least one sub-section being different in shape as compared to the any other section of the susceptor. The support section may have at least a first and a second sub-section being different in shape. For example, the support section may be staggered cylinder or a cylinder comprising a protruding end plate.

Advantageously, the support section is a thermal insulator in order to prevent heat being transferred from the susceptor to the device housing, the main body, or the mouthpiece. Likewise, if the support section is a thermal insulator, a user may readily handle the susceptor by grasping the support section without the risk of burning.

As used herein, the term "aerosol-forming substrate" relates to a substrate capable of releasing volatile compounds that can form an aerosol upon heating the aerosol-forming substrate. The aerosol-forming substrate may conveniently be part of an aerosol-generating article. Hence, as used herein the term "aerosol-forming substrate" may be replaced by "aerosol-generating article including aerosol-forming substrate". Accordingly, the heating chamber may be configured for receiving at least partially an aerosol-generating article including an aerosol-forming substrate to be heated. Preferably, the heating chamber is configured for completely receiving the aerosol-forming substrate, that is, that portion of the aerosol-generating article which includes the aerosol-forming substrate. When being received at least partially in the heating chamber, other portions of the aerosol-generating article may be arranged outside of the heating chamber or even outside of the device housing. Accordingly, the reusable susceptor may be configured to get into removable contact with the aerosol-forming substrate of the aerosol-generating article for heating the substrate. Likewise, the aerosol-generating device may be configured such the aerosol-generating article is securely retained in the heating chamber at least against a force that corresponds to the total weight of the article or the total weight of the article and the susceptor. Likewise, the support section may protrude at least partially from the aerosol-generating article including the aerosol-forming substrate upon getting into contact with the aerosol-forming substrate.

The aerosol-forming substrate may be a solid or a liquid aerosol-forming substrate. In both cases, the aerosol-forming substrate may comprise both solid and liquid components. The aerosol-forming substrate may comprise a tobacco-containing material including volatile tobacco flavour compounds, which are released from the substrate upon heating. Thus, the aerosol-forming substrate may be a tobacco-containing aerosol-forming substrate. Likewise, an aerosol-generating article including an aerosol-forming substrate according to the invention and as described herein may be a tobacco-containing aerosol-generating article. The tobacco-containing material may comprise loosed filled or packed tobacco, or sheets of tobacco which have been gathered or crimped. Alternatively or additionally, the aerosol-forming substrate may comprise a non-tobacco material. The aerosol-forming substrate may further comprise an aerosol former. Examples of suitable aerosol formers are glycerine and propylene glycol. The aerosol-forming substrate may also comprise other additives and ingredients, such as nicotine or flavourants. The aerosol-forming substrate may also be a paste-like material, a sachet of porous material comprising aerosol-forming substrate, or, for example, loose tobacco mixed with a gelling agent or sticky agent, which could include a common aerosol former such as glycerine, and which is compressed or molded into a plug.

As already mentioned above, the device may comprise a main body and a mouthpiece which is removably attached to the main body. The heating chamber may be in the main body, whereas the susceptor preferably is removably attached to the mouthpiece. The mouthpiece may further have an outlet through which aerosol generated by the device can be drawn out. As used herein, the term 'mouthpiece' means a portion of the device that is placed into a user's mouth in order to directly inhale an aerosol generated by the aerosol-generating system. The aerosol is conveyed to the user's mouth through the mouthpiece.

The device housing comprises at least one air inlet into the heating chamber. Preferably, the device comprises an air path extending from the at least one air inlet through the heating chamber to at least one air outlet. The air outlet preferably is an outlet of the mouthpiece. The air path may pass the susceptor. The air path may also pass the inductor coil. The air path may include an airflow passage provided between the inductor coil and the susceptor. Thereby, vaporized aerosol-forming material may be entrained in the air flowing in the airflow passage, which subsequently cools to form an aerosol that escapes through the air outlet. To allow air flowing along the air path through the heating chamber, the support section of the susceptor may comprise at least one vent.

For generating the alternating electromagnetic field, the induction source may comprise an inductor coil. The induction source may further comprise an AC generator operatively coupled to the inductor coil. The AC generator is configured to generate a high frequency oscillating current to be passed through the inductor coil for generating an alternating electromagnetic field. As used herein, a high frequency oscillating current means an oscillating current having a frequency between 500 kHz and 30 MHz, preferably between 1 MHz and 10 MHz and more preferably between 5 MHz and 7 MHz.

The device may further comprise an electric circuitry for controlling the operation of the device, in particular the heating process. Preferably, the electric circuitry includes the AC generator, in particular a DC/AC inverter. The electric circuitry may comprise a microprocessor, a microcontroller, or other electronic circuitry capable of providing control. In particular, the electric circuitry may be configured to regulate a supply of current to the inductor coil. Current may be supplied to the inductor coil continuously following activation of the system or may be supplied intermittently, such as on a puff by puff basis.

The aerosol-generating device may comprise a power supply, operatively connected to the induction source and the electric circuitry, respectively. Preferably, the power supply is a battery such as a lithium iron phosphate battery. Alternatively, the power supply may be another form of charge storage device such as a capacitor. The power supply may require recharging and may have a capacity that allows for the storage of enough energy for one or more user experiences. For example, the power supply may have sufficient capacity to allow for the continuous generation of aerosol for a period of around six minutes or for a period that is a multiple of six minutes. In another example, the power supply may have sufficient capacity to allow for a predetermined number of puffs or discrete activations of the inductor coil.

The device may comprise a single inductor coil or a plurality of inductor coils. The inductor coil or coils may have a shape matching the shape of the susceptor. Likewise, the inductor coil or coils may have a shape to conform to a shape of a heating chamber. For example, the inductor coil or coils may be a helical coil or flat spiral coil. The use of helical coils allows for generating homogenous fields which may prove advantageous with regard to a homogenous heating of the susceptor. The term "flat spiral coil" as used herein covers coils that are planar as well as flat spiral coils that are shaped to conform to a curved surface. The flat spiral coil may have a circular shape or may have a generally oblong or rectangular shape. The use of a flat spiral coil allows for designing a compact device, having a simple design that is robust and inexpensive to manufacture. The coil can be held within a housing of the device and need not to be exposed to generated aerosol so that deposits on the coil and possible corrosion can be prevented. The inductor coil may be covered by a corrosion resistant coating or enclosure. The inductor coil may be positioned on or adjacent a surface of the heating chamber closest to the power supply. The inductor coil is preferably immovable relative to the heating chamber. This reduces the amount and complexity of electrical connections within the device. Alternatively, the inductor coil may also be within the heating chamber. Alternatively, the inductor coil may be arranged in a mouthpiece of the device. Advantageously, in the operation position the susceptor is positioned in the vicinity of the inductor coil. It is also desirable that the distance between the inductor coil and the susceptor is substantially constant across the extent of the susceptor as to ensure homogenous heating. Preferably, the minimum distance between the susceptor and the inductor coil is below 2 mm, in particular below 1 mm, or even below 0.5 mm.

According to the invention there is also provided an aerosol-generating system for generating an aerosol by inductively heating an aerosol-forming substrate. The system comprises an aerosol-generating device according to the invention and as described herein as well as an aerosol-generating article including an aerosol-forming substrate to be heated. The aerosol-generating article is at least partially receivable in the heating chamber of the aerosol-generating device. Yet, it is preferred that that at least that portion of the aerosol-generating article which includes the aerosol-forming substrate is completely receivable or received in the heating chamber. Advantageously, this increases the generation of aerosol. When being received at least partially received within the heating chamber, other portions of the aerosol-generating article may be arranged outside of the heating chamber or even outside of the device housing.

The aerosol-forming substrate or the aerosol-generating article may be a consumable, that is, a disposable substrate or article to be discarded after use. The aerosol-forming substrate or the aerosol-generating article may be elongated or rod-shaped. In particular, the aerosol-generating article may be a tobacco rod. For example, the aerosol-generating article may be a rod of aerosol-forming substrate wrapped by paper. The rod may also comprise a filter at one end of the rod. According to another example, the aerosol-generating article may comprise several elements arranged in coaxial alignment, such as the aerosol-forming substrate, a support element, an aerosol-cooling element, and a mouthpiece. Each of these elements may be a substantially cylindrical element, each having substantially the same diameter. The elements are preferably arranged sequentially and circumscribed by an outer wrapper to form a cylindrical rod. Alternatively, the aerosol-generating article may be a cartridge comprising a solid or a liquid aerosol-forming substrate.

The aerosol-generating article may comprise a preformed penetration opening in the aerosol-forming substrate for the susceptor to penetrate an internal portion of the aerosol-forming substrate. Advantageously, this facilitates the susceptor to get into contact with the aerosol-forming substrate.

The susceptor may be removably attached to the aerosol-generating article whereas the aerosol-generating article may be captively receivable or received in the heating chamber such that the susceptor is arrangeable or arranged in the operation position without direct contact to the heating chamber. Advantageously, this allows having the susceptor to be completely separate from any other parts of the aerosol-generating device and thus to be readily accessible.

Further features and advantages of aerosol-generating system according to the invention, in particular of the aerosol-generating device, the aerosol-generating article, the aerosol-forming substrate and the susceptor, have been described with regard to aerosol-generating device according to the invention and will not be repeated.

The invention will be further described, by way of example only, with reference to the accompanying drawings, in which:

FIG. 1 schematically illustrates a cross sectional view of an aerosol-generating device according to a first embodiment of the invention;

FIGS. 2-4 schematically illustrate a perspective view of the device according to FIG. 1 with the susceptor displaced in different positions;

Figure 1:
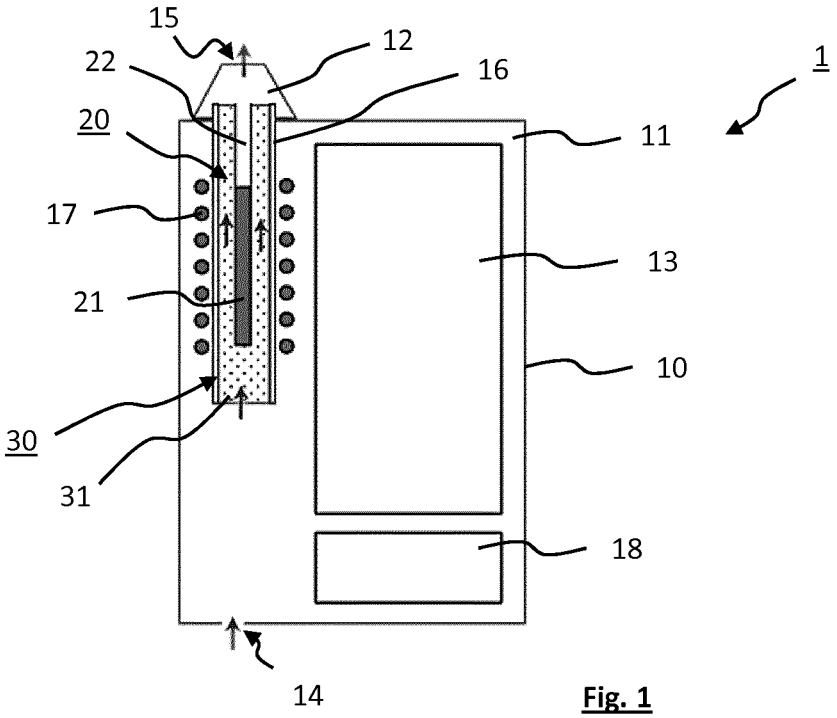
Figure 12:
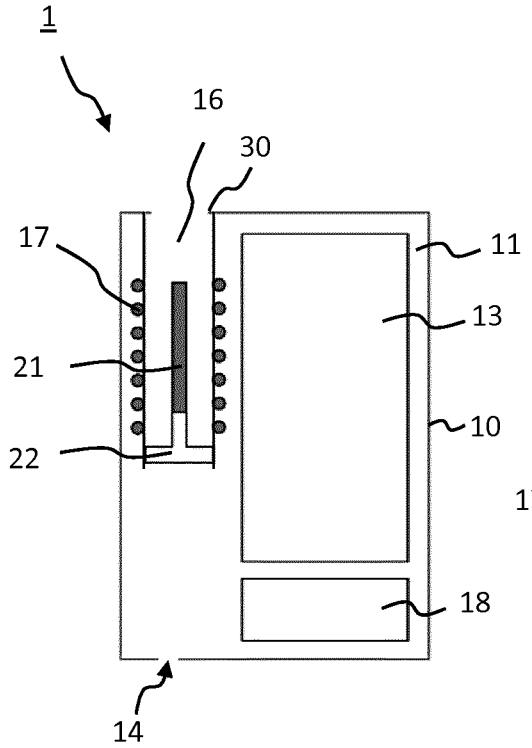
Figure 13:
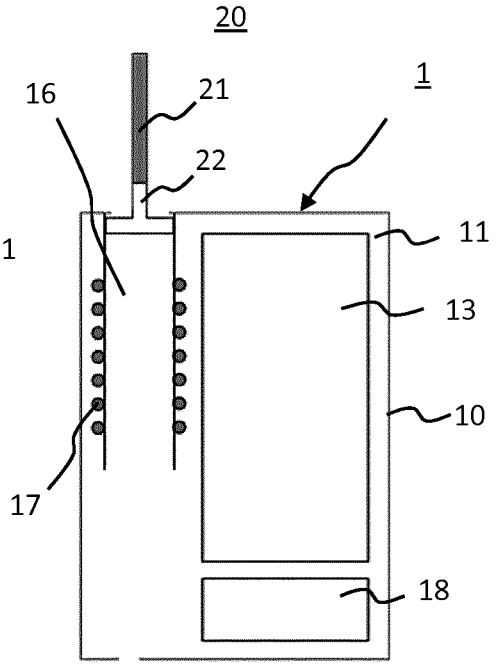
Figure 14:
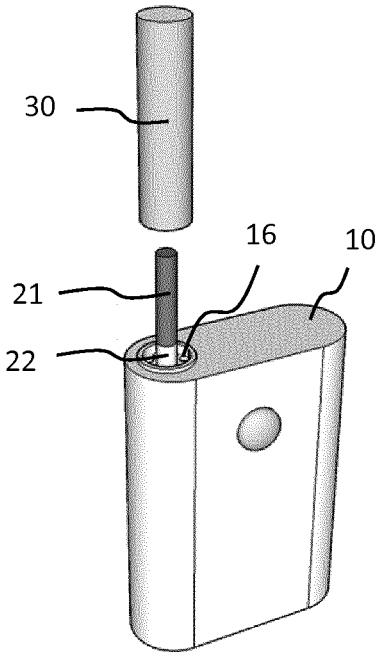
Figure 15:
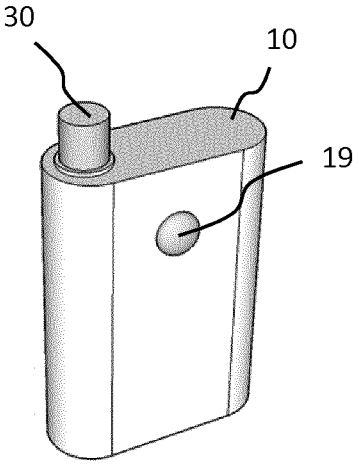

FIGS. 12-13 schematically illustrates a cross sectional view of an aerosol-generating device according to a second embodiment of the invention;

FIGS. 14-15 schematically illustrate a perspective view of the device according to FIGS. 12 and 13 with the susceptor displaced in different positions; and FIG. 16-20 schematically illustrates a susceptor and an aerosol-generating device according to a third embodiment of the invention;

FIG. 1 schematically illustrates an aerosol-generating device 1 according to a first embodiment of the present invention which is configured for thermally generating an aerosol by inductively heating an aerosol-forming substrate received therein. The device 1 comprises a main body 11 which contains a lithium ion battery as power supply 13, and an electric circuitry 18 for controlling the operation of the device 1, in particular for controlling the heating process.

Within the main body 11, the device 1 further comprises a heating chamber 16 for receiving an aerosol-generating article 30 that includes the aerosol-forming substrate 31 to be heated. The heating chamber 16 is open at one end such as to allow the article 30 to be inserted therein. The heating chamber 16 may be closed by a frustum-shaped mouthpiece 12 which is removably attached to the main body 11. The mouthpiece 12 may be connected to the main body 11 by any kind of connection, such as by a hinged connection, a snap fitting, or a screw fitting. The housing of the main body 11 and the mouthpiece 12 together form the device housing 10. The device 1 further comprises an air path extending from at least one air inlet 14 at the bottom of the device 1 through the heating chamber 16 to at least one air outlet 15 in the mouthpiece 12.

For heating the aerosol-forming substrate 31 within the heating chamber 16, the device 1 comprises an inductive heater which essentially includes two components: an induction source for generating a high frequency alternating electromagnetic field as well as a susceptor 20 which heats up due to eddy currents and/or hysteresis loss induced by the alternating electromagnetic. In the present embodiment, the susceptor 20 comprises a rod-shaped heating section 21 made of ferromagnetic stainless steel that is brought into direct contact with an internal portion of the aerosol-forming substrate 31 such as to heat the substrate from the inside. The induction source comprises a helical inductor coil 17 which is operatively connected to an AC generator that is part of the electric circuitry 18. The helical coil is arranged within the main body 11 such as to surround at least a major axial portion of the cylindrical heating chamber 16. This allows for generating an alternating electromagnetic field that is essentially homogenous within the heating chamber 16. This proves advantageous with regard to a homogenous heating of the susceptor 20 and thus to a homogenous heating of the substrate 31 within the article 30. Prior to focusing on further details of the susceptor 20, the basic functionality of the aerosol-generating device will be explained first.

In use, a user may puff on the mouthpiece 12 to draw air though the air inlet 14 into the heating chamber 16 and further through the outlet 15 of the mouthpiece 12 into the user's mouth. The device may include a puff sensor (not shown), such as a microphone, for detecting when a user puffs on the mouthpiece. The puff sensor may be part of the control electric circuitry 18. When a puff is detected, the AC generator of the electric circuitry 18 provides a high frequency oscillating current to the coil 17. This generates an oscillating magnetic field which passes through the susceptor 20. As a consequence, the ferromagnetic heating section 21 of the susceptor 20 heats up and reaches a temperature sufficient to vaporize the aerosol-forming substrate 31. Thus, vaporized aerosol-forming material generated within the heating chamber 16 is entrained in the air flowing from the inlet 14 to the outlet 15 in the mouthpiece 12. Along this way, the vapor cools to form an aerosol within the mouthpiece 12 before escaping through the outlet 15. The oscillating current is applied to the coil 17 for a predetermined duration, in this example five seconds, after detection of a puff and then switches the current off until a new puff is detected. Alternatively, the heating process may be activated and deactivated manually, for example by pressing an activation button 19 on the device housing 10 as shown in FIGS. 2-4.

According to the invention, the susceptor is a reusable susceptor. That is, the susceptor 20 is configured for multiple use with a plurality of substrates or articles. For this, it is crucial that the susceptor 20 may get into and out of contact with the substrate without getting damaged such as to be used again with another substrate. This in turn requires the susceptor 20 to be readily accessible for replacement of the aerosol-generating articles and also for other preparation purposes, such as cleaning of the susceptor. According to the present the invention, accessibility of the susceptor 20 is realized by having the susceptor 20 displaceable between at least two positions, an operation position in which the susceptor 20 is arranged within the heating chamber 16, and a preparation position in which the susceptor 20 is arranged at least partially outside of the heating chamber.

Figure 2:
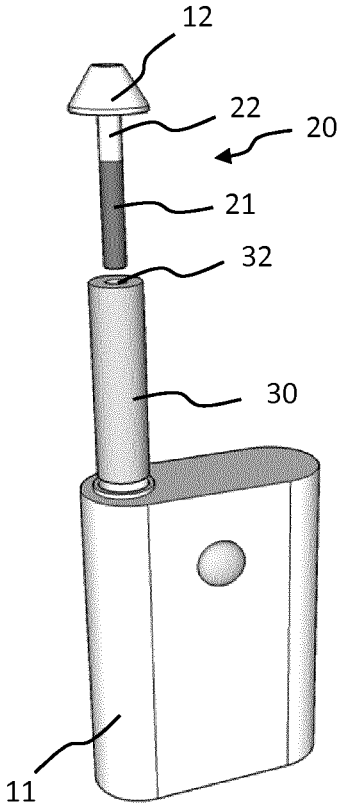
Figure 3:
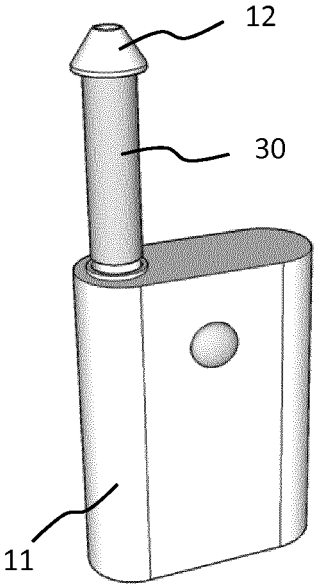
Figure 4:
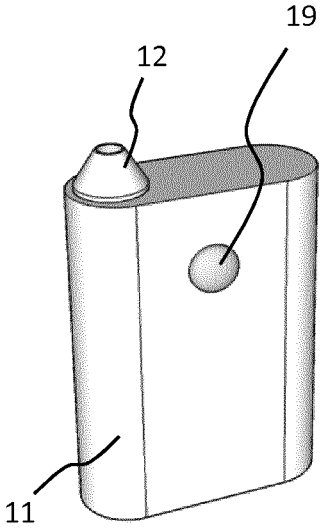

FIGS. 1-11 show a first embodiment of a displaceable susceptor 20. As can be seen from FIGS. 2-4, the susceptor 20 is attached to the frustum-shaped mouthpiece 12. As such, it is integral part of the aerosol-generating device 1. As the mouthpiece is removably attached to the main body 11, the susceptor 20 may be easily arranged within the heating chamber 16, that is, in the operation position, by attaching the mouthpiece 12 to the main body 11. Vice versa, by removing the mouthpiece 12 from the main body 11, the susceptor 20 may be readily removed from the heating chamber 16 and transferred into the preparation position outside of the heating chamber 16. FIG. 1 and FIG. 4 show the susceptor 20 in the operation position, whereas FIG. 2 and FIG. 3 show the susceptor 20 in the preparation position.

Figure 6:
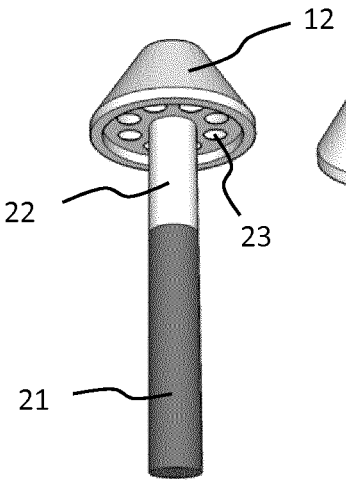
FIGS. 6-11 show different embodiments of a susceptor of the device according to FIGS. 1 to 4.
Figure 7:
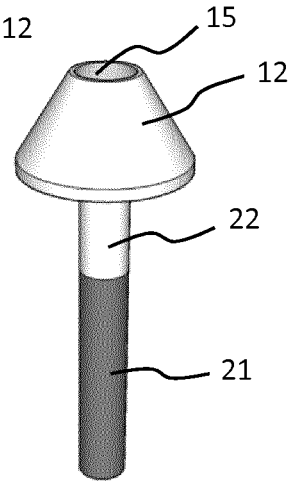

FIG. 6 and FIG. 7 show further details of the susceptor 20 according to the first embodiment. The susceptor 20 basically comprises a rod-shaped heating section 21 which is made of ferromagnetic stainless steel. Thus, when brought into the alternating electromagnetic field of the inductor coil 17, the heating section 21 heats up due to hysteresis losses and eddy currents. The susceptor 20 further comprises a rod-shaped support section 22 for attaching the heating section 21 to the interior of the frustum-shaped mouthpiece 12. The support section 22 is a thermal insulator which prevents heat to be transferred from the heating section 21 to the mouthpiece 12 during operation of the device 1.

A perforated circular end plate is arranged in a base portion of the frustum-shaped mouthpiece 12. The plate comprises a plurality of vent holes 23 such as to allow air and aerosol to flow from the heating chamber 16 to the outlet 15 in the mouthpiece 12. The vent holes 23 are circularly arranged around a center of the circular end plate to which the support section 22 of the susceptor 20 is attached. In the present embodiment, the end plate is part of the mouthpiece 12. Alternatively, the end plate may be part of the susceptor 20, in particular of the support section 22.

Figures 8, 9:
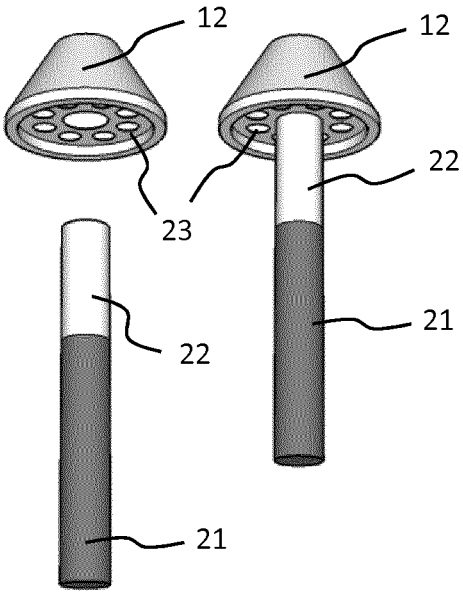
Figures 10, 11:
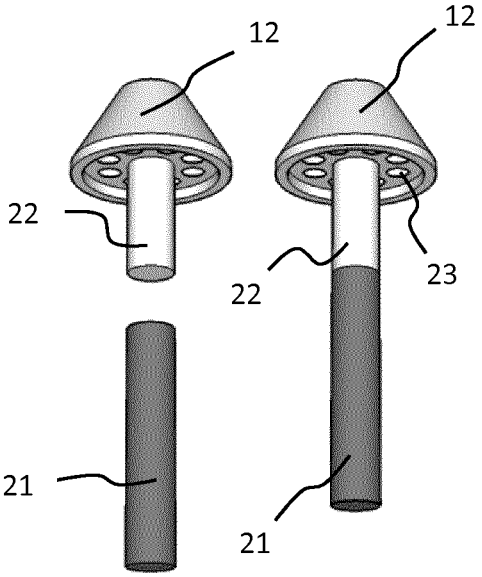

To further increase the accessibility of the susceptor 20, in particular to allow for replacing the susceptor, the susceptor 20 may be removably attached to the mouthpiece 12. As shown in FIG. 8 and FIG. 9, the support section 22 is reversibly attached to (FIG. 9) and detached from (FIG. 8) the perforated end plate of the mouthpiece 12. At its opposite end, the support section 22 is fixedly attached to the heating section 21. Alternatively, as shown in FIG. 10 and FIG. 11, the support section 22 may be reversibly attached to (FIG. 11) and detached from (FIG. 8) the heating section 21, whereas it is fixedly attached to the mouthpiece 12, that is to the perforated end plate of the mouthpiece 12. For removably attaching the support section 22 either to the mouthpiece or the heating section 21, the susceptor 20 may comprise at least one of a clamp mount, a screw mount, a snap mount, or a magnetic mount.

The support section 22 has the same diameter as the heating section 21 which advantageously facilitates insertion of the susceptor 20 into the substrate 31 of the aerosol-generating article 30. In particular, the free end of the heating section 21 is an anterior end of the susceptor 20 configured for getting into contact with the aerosol-forming substrate 31 first. In contrast, the support section is a posterior end of the susceptor 20 opposite to the anterior end.

Figure 5:
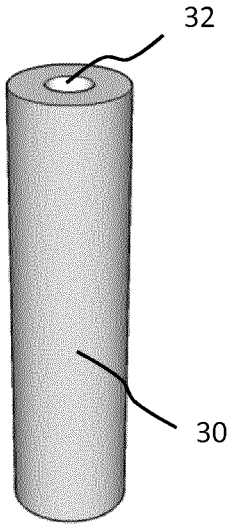
FIG. 5 shows an example of an aerosol-generating article to be used with the device according to FIGS. 1 to 4.

FIG. 5 shows further details of the aerosol-generating article 30. In the present embodiment, the aerosol-generating article 30 is a rod of aerosol-forming substrate 31 wrapped by paper. At one end, aerosol-generating article 30 comprises a preformed penetration opening 32 in the aerosol-forming substrate 31 for the susceptor to penetrate an internal portion of the substrate 31. Advantageously, this facilitates penetration of the aerosol-forming substrate 31 by the susceptor 20. The diameter of penetration opening 32 essentially corresponds to the diameter of the heating section 21 and the support section 22 of the susceptor 20 such that the susceptor 20 is in friction-fit with the aerosol-forming substrate 31 upon insertion. Thus, the aerosol-generating article 30 may be removably but securely attached to the susceptor 20 without the risk of being lost.

At the other end opposite to the penetration opening 32, the aerosol-generating article 30 may comprise a filter. Alternatively, a filter may be integrated within the mouthpiece 12.

FIGS. 2-4 illustrate the steps for putting the aerosol-generating device 1 according to the first embodiment into operation. First, the susceptor 20—being attached to the mouthpiece 12—is inserted into the penetration slot 32 in the aerosol-generating article 30. After that, the article 30—with the susceptor 20 and the mouthpiece 12 attached thereto—is inserted into the heating chamber 16 of the device until the bottom side of the mouthpiece 12 gets into contact with the main body 11. In this position, the mouthpiece is removably attached to the main body 11, and the susceptor 20 is arranged in its operation position within the heating chamber 16 (see FIG. 1 and FIG. 4). The diameter of the aerosol-generating article 30 is slightly smaller than the inner diameter of the cylindrical heating chamber 16 such as to provide an air passageway along the inner surface of the heating chamber 16. Likewise, the length extension of the aerosol-generating article 30 may be smaller than the axial length of the heating chamber 16. By removing the mouthpiece 12 from the main body 11, the aerosol-generating article 30 and the susceptor 20 may be readily removed from the heating chamber 16 and transferred into the preparation position outside of the heating chamber 16 (see FIGS. 2 and 3). There, the susceptor 20 is readily accessible for replacement of the aerosol-generating article 30 and also for other preparation purposes, such as cleaning of the susceptor 20.

FIGS. 12-15 illustrate a second embodiment of the aerosol-generating device 1. The basic setup of the device according to this second embodiment is very similar to the first embodiment. Therefore, identical or equivalent features are denoted with the same reference numerals. Yet, in contrast to the first embodiment, the susceptor 20 according to the second embodiment is slidably mounted in the heating chamber 16 such as to be displaceable between the operation position and the preparation position by a sliding movement. Like in the first embodiment, the susceptor 20 also comprises a heating section 21 and a support section 22. The heating section 21 is a cylindrical rod made of stainless steel. The heating section 21 forms the anterior end of the susceptor 20 that is getting into contact with the aerosol-forming substrate 31 first. In contrast, the support section 22 forms the posterior end of the susceptor 20 having a cylindrical sub-section to which the heating section 21 is attached. Furthermore, at is very end the support section 21 comprise a protruding circular end plate which is slidably guided within the cylindrical heating chamber 16 in a form fitting manner. Advantageously, the device 1 may also comprise one or more guide members, such as guide pins, for slidably guiding the susceptor 20. Advantageously, the support section 22 is a thermal insulator which prevents heat to be transferred from the heating section 21 to the device housing 10 during operation of the device 1.

Figure 16:
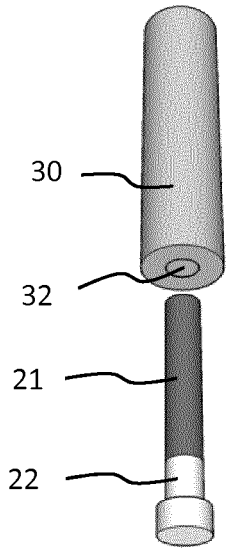
Figure 17:
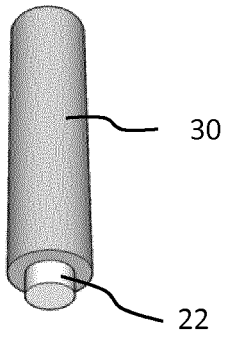
Figure 18:
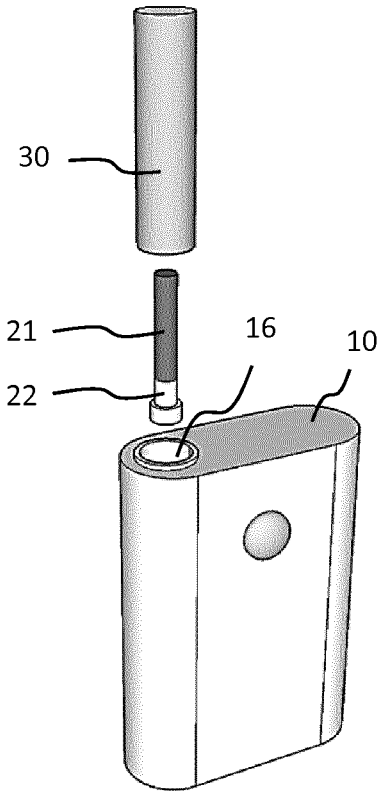
Figure 19:
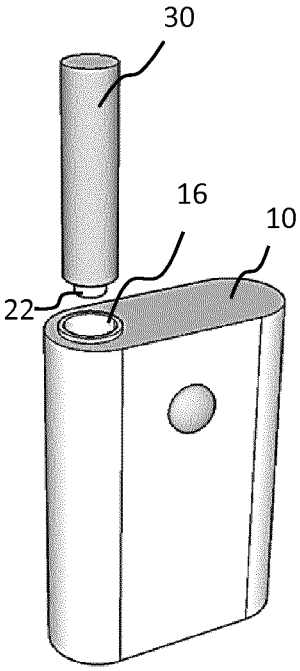
Figure 20:
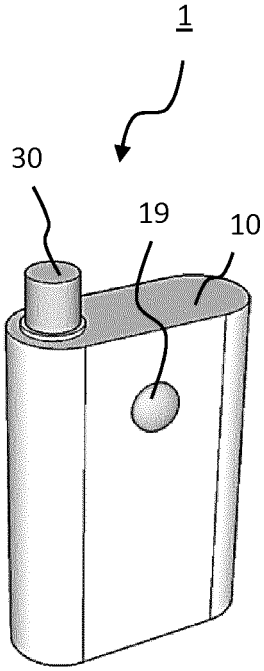

FIG. 12 shows the susceptor 20 being in the operation position within the heating chamber 16. In this position, a rod-like aerosol-generating article—for example as shown in FIG. 5—may be inserted into the heating chamber 16 such that the free anterior end of the susceptor 20—which faces the opening of the heating chamber 16—may penetrate into the substrate of the aerosol-generating article 30. The article may also have a penetration opening 32 at that end which faces the susceptor 20 upon being inserted into the heating chamber 16. FIG. 15 shows the device 1 having an aerosol-generating article engaged with the susceptor 20 within the heating chamber 16 and thus being ready for a user experience. For removing the aerosol-generating article 30 from the susceptor 20, the aerosol-generating article 30 may be manually pulled out of the heating chamber 16. Advantageously, the susceptor 20 is in friction-fit with the aerosol-forming substrate 31 such that the susceptor 20 is atomically carried along out of the heating chamber 16, as shown in FIG. 16. In order to prevent the susceptor 20 from being completely removed from the device housing 10, the aerosol-generating device 1 comprise a stopper 30 at the opening of the heating chamber 16 against which the protruding circular end plate of the support section 22 may abut. In this position, the susceptor 20 is in the preparation position. By further pulling on the aerosol-generating article 30, the article 30 can be completely removed from the susceptor 20, as shown in FIG. 13 and FIG. 14. In the preparation position, the susceptor 20 is freely accessible for any kind of preparation purposes, such as cleaning. In case the susceptor 20 is not automatically carried along out of the heating chamber 16 upon pulling back the aerosol-generating article after use, the susceptor may also manually displaced out of the heating chamber 16.

The aerosol-generating article 30 may be also engaged with the susceptor 20 when being in the preparation position instead of the operation position. Subsequently, the susceptor 20 may be displaced together with the aerosol-generating article 30 attached thereto into the operation position.

FIGS. 16-20 illustrate a third embodiment of the aerosol-generating device. The basic setup of this third embodiment is very similar to the first and second embodiment. Therefore, identical or equivalent features are denoted with the same reference numerals. Yet, in contrast to the first and second embodiment, the susceptor 20 according to the third embodiment is freely movable relative to the heating chamber 16 and the device housing 10. The susceptor 20 is even completely displaceable out of the heating chamber 16 and the device housing 10. For arranging the susceptor 20 in the operation position, the susceptor may be first removably inserted into the aerosol-forming substrate of an aerosol-generating article 30 outside of the device housing 1, that is in the preparation position of the susceptor 20 (see FIG. 16 and FIG. 18). Subsequently, the article 30 together with the susceptor 20 attached thereto (see FIG. 17 and FIG. 19) may be inserted into the heating chamber 16 until the susceptor 20 is in its operation position.

The susceptor 20 according to the third embodiment also comprises a heating section 21 and a support section 22 attached to each other. The heating section 21 is a continuous cylindrical rod made of stainless steel which forms the anterior end of the susceptor 20 that is getting into contact with the aerosol-forming substrate 31 first. In contrast, the support section 22 is a staggered cylinder forming the posterior end of the susceptor 20. A first cylinder stage next to the heating section 21 has the same diameter as the heating section 21. A second cylinder stage at the very end of the susceptor 20 has a diameter larger than the heating section 21 and larger than the diameter of the penetration opening 32 at the tip end of the aerosol-generating article 30. Accordingly, the susceptor 20 may be inserted into aerosol-generating article 30 until the second cylinder stage abuts against the tip end of the article 30. Thus, the second cylinder stage of the support section 22 serves as insertion stop. Furthermore, the support section 22 serves a grasp or a knob allowing a user to readily grasping the susceptor 20. Preferably, the support section is a thermal insulator. Thus, a user may handle the susceptor without the risk of burning.

Preferably, the susceptor 20 and aerosol-generating article 30 are removably attached to each other due to friction-fit upon penetration of the susceptor 20 into the substrate of the article 30. Advantageously, this prevents the susceptor from getting unintentionally lost. Likewise, the aerosol-generating article is also securely received in the heating chamber 16 in order such as to avoid an unintentionally drop out of the aerosol-generating article 30.

The invention claimed is:

1. An aerosol-generating device for generating an aerosol by inductively heating an aerosol-forming substrate, the device comprising:

a device housing comprising a heating chamber for receiving an aerosol-forming substrate to be heated;

an induction source within the device housing for generating an alternating electromagnetic field within the heating chamber;

a reusable susceptor configured to get into removable contact with the aerosol-forming substrate for heating the substrate, wherein the susceptor is displaceable between an operation position defined by the susceptor being arranged within the heating chamber, and a preparation position defined by the susceptor being arranged at least partially outside of the heating chamber, wherein the susceptor comprises a heating section which is inductively heatable and an inductively non-heatable support section configured to get at least partially into contact with the aerosol-forming substrate, wherein at least a sub-section of the support section arranged next to the heating section has the same shape as the heating section; and a main body and a mouthpiece removably attached to the main body, wherein the susceptor is attached to the mouthpiece by the support section.

2. The aerosol-generating device according to claim 1, wherein the susceptor is removably attached to the mouthpiece.

3. The aerosol-generating device according to claim 1, wherein at least a section of the susceptor is one of a rod, a blade, a tube, a needle, or a lance.

4. The aerosol-generating device according to claim 1, wherein the support section is a thermal insulator.

5. The aerosol-generating device according to claim 1, the support section comprises at least one vent.

6. The aerosol-generating device according to claim 1, wherein the device housing comprises at least one air inlet into the heating chamber.

7. An aerosol-generating system for generating an aerosol by inductively heating an aerosol-forming substrate, the system comprising an aerosol-generating device according to claim 1 and an aerosol-generating article including the aerosol-forming substrate to be heated, wherein the aerosol-generating article is at least partially receivable or received in the heating chamber of the aerosol-generating device.

8. The aerosol-generating system according to claim 7, wherein the aerosol-generating article comprises a preformed penetration opening in the aerosol-forming substrate for the susceptor to penetrate an internal portion of the aerosol-forming substrate.

9. An aerosol-generating device for generating an aerosol by inductively heating an aerosol-forming substrate, the device comprising:

a device housing comprising a heating chamber for receiving an aerosol-forming substrate to be heated;

an induction source within the device housing for generating an alternating electromagnetic field within the heating chamber; and a reusable susceptor configured to get into removable contact with the aerosol-forming substrate for heating the substrate, wherein the susceptor is displaceable between an operation position defined by the susceptor being arranged within the heating chamber, and a preparation position defined by the susceptor being arranged at least partially outside of the heating chamber, wherein the susceptor comprises a heating section which is inductively heatable and an inductively non-heatable support section configured to get at least partially into contact with the aerosol-forming substrate, wherein at least a sub-section of the support section arranged next to the heating section has the same shape as the heating section, wherein the susceptor is slidably mounted in the device housing by the support section.

10. The aerosol-generating device according to claim 9, wherein at least a section of the susceptor is one of a rod, a blade, a tube, a needle, or a lance.

11. The aerosol-generating device according to claim 9, wherein the support section is a thermal insulator.

12. The aerosol-generating device according to claim 9, wherein the device housing comprises at least one air inlet into the heating chamber.

13. The aerosol-generating device according to claim 9, wherein the susceptor is captively coupled to the device housing.

14. The aerosol-generating device according to claim 9, wherein the support section protrudes at least partially from the aerosol-forming substrate upon getting into contact with the aerosol-forming substrate.

15. An aerosol-generating system for generating an aerosol by inductively heating an aerosol-forming substrate, the system comprising an aerosol-generating device according to claim 9, and an aerosol-generating article including the aerosol-forming substrate to be heated, wherein the aerosol-generating article is at least partially receivable or received in the heating chamber of the aerosol-generating device.

16. The aerosol-generating system according to claim 15, wherein the aerosol-generating article comprises a preformed penetration opening in the aerosol-forming substrate for the susceptor to penetrate an internal portion of the aerosol-forming substrate.

17. An aerosol-generating device for generating an aerosol by inductively heating an aerosol-forming substrate, the device comprising:

a device housing comprising a heating chamber for receiving an aerosol-forming substrate to be heated;

an induction source within the device housing for generating an alternating electromagnetic field within the heating chamber;

a reusable susceptor configured to get into removable contact with the aerosol-forming substrate for heating the substrate, wherein the susceptor is displaceable between an operation position defined by the susceptor being arranged within the heating chamber, and a preparation position defined by the susceptor being arranged at least partially outside of the heating chamber, wherein the susceptor is separate from any other part of the device, wherein the susceptor comprises a heating section which is inductively heatable and an inductively non-heatable support section arranged at a posterior end of the susceptor serving a grasp allowing a user to grasp the susceptor in order to insert and remove the susceptor into and from the aerosol-forming substrate, wherein the support section is configured to get at least partially into contact with the aerosol-twining substrate, and wherein at least a sub-section of the support section arranged next to the heating section has the same shape as the heating section.

18. The aerosol-generating device according to claim 17, wherein at least a section of the susceptor is one of a rod, a blade, a tube, a needle, or a lance.

19. The aerosol-generating device according to claim 17, wherein the support section is a thermal insulator.

20. The aerosol-generating device according to claim 17, wherein the device housing comprises at least one air inlet into the heating chamber.

21. An aerosol-generating system for generating an aerosol by inductively heating an aerosol-forming substrate, the system comprising an aerosol-generating device according to claim 17, and an aerosol-generating article including the aerosol-forming substrate to be heated, wherein the aerosol-generating article is at least partially receivable or received in the heating chamber of the aerosol-generating device.

22. The aerosol-generating system according to claim 21, wherein the aerosol-generating article comprises a preformed penetration opening in the aerosol-forming substrate for the susceptor to penetrate an internal portion of the aerosol-forming substrate.

23. The aerosol-generating system according to claim 21, wherein the susceptor is removably attached to the aerosol-generating article and wherein in the aerosol-generating article is captively receivable or received in the heating chamber such that the susceptor is arrangeable or arranged in the operation position without direct contact to the heating chamber.

* * * * *